US010086246B2

(12) United States Patent
Johnson et al.

(10) Patent No.: US 10,086,246 B2
(45) Date of Patent: Oct. 2, 2018

(54) GOLF CLUB FABRICATED FROM BULK METALLIC GLASSES WITH HIGH TOUGHNESS AND HIGH STIFFNESS

(71) Applicant: GlassiMetal Technology, Inc., Pasadena, CA (US)

(72) Inventors: William L. Johnson, San Marino, CA (US); David S. Lee, Wenham, MA (US); Marios D. Demetriou, West Hollywood, CA (US); Jong Hyun Na, Pasadena, CA (US); Glenn Garrett, Pasadena, CA (US)

(73) Assignee: GlassiMetal Technology, Inc., Pasadena, CA (US)

( * ) Notice: Subject to any disclaimer, the term of this patent is extended or adjusted under 35 U.S.C. 154(b) by 0 days.

(21) Appl. No.: 14/167,710

(22) Filed: Jan. 29, 2014

(65) Prior Publication Data

US 2014/0213384 A1 Jul. 31, 2014

Related U.S. Application Data

(60) Provisional application No. 61/757,979, filed on Jan. 29, 2013, provisional application No. 61/778,965, filed on Mar. 13, 2013.

(51) Int. Cl.
*A63B 53/04* (2015.01)
*A63B 60/00* (2015.01)

(52) U.S. Cl.
CPC ..... *A63B 60/00* (2015.10); *A63B 2053/042* (2013.01); *A63B 2053/0408* (2013.01); *A63B 2053/0416* (2013.01); *A63B 2209/00* (2013.01)

(58) Field of Classification Search
CPC ..... A63B 53/00; A63B 2909/00; A63B 2053/0408; A63B 2053/0416;
(Continued)

(56) References Cited

U.S. PATENT DOCUMENTS 3,856,513 A 12/1974 Chen et al.
4,252,262 A 2/1981 Igarashi et al.
(Continued)

FOREIGN PATENT DOCUMENTS

EP 2951329 A1 12/2015
JP 0533071 B2 5/1993
(Continued)

OTHER PUBLICATIONS

International Preliminary Report on Patentability for International Application PCT/US2014/013625, issued Aug. 4, 2015, dated Aug. 13, 2015, 5 pgs.
(Continued)

*Primary Examiner* — Sebastiano Passaniti
(74) *Attorney, Agent, or Firm* — KPPB LLP

(57) ABSTRACT

Golf clubs formed from bulk-solidifying amorphous metals (i.e., metallic glasses) having high elastic modulus and fracture toughness, and to methods of forming the same are provided. Among other components, the golf club materials disclosed enable fabrication of flexural membranes or shells used in golf club heads (drivers, fairways, hybrids, irons, wedges and putters) exhibiting enhanced flexural or bending compliance together with the ability to deform plastically and avoid brittle fracture or catastrophic failure when overloaded under bending loads. Further, the high strength of the material and its density, comparable to that of steel, enables the redistribution of mass in the golf club while maintaining a desired overall target mass.

14 Claims, 2 Drawing Sheets

(58) Field of Classification Search
CPC ..... A63B 2053/042; A63B 2053/0425; A63B 2053/0429
USPC ..... 473/324–350, 287–292
See application file for complete search history.

(56) References Cited

U.S. PATENT DOCUMENTS

| | | | | |
|---|---|---|---|---|
| 4,298,382 | A | 11/1981 | Stempin | |
| 4,455,177 | A | 6/1984 | Filippov et al. | |
| 4,699,383 | A | 10/1987 | Kobayashi | |
| 4,708,347 | A | 11/1987 | Kobayashi | |
| 4,754,975 | A | 7/1988 | Aizawa | |
| 4,802,844 | A | 2/1989 | Kuhn et al. | |
| 4,857,414 | A | 8/1989 | Araki et al. | |
| 4,928,965 | A | 5/1990 | Matsushita et al. | |
| 4,964,927 | A | 10/1990 | Shiflet et al. | |
| 4,965,139 | A | 10/1990 | Ferrando et al. | |
| 5,024,437 | A | 6/1991 | Anderson | |
| 5,032,196 | A | 7/1991 | Masumoto et al. | |
| 5,074,935 | A | 12/1991 | Masumoto et al. | |
| 5,094,383 | A | 3/1992 | Anderson et al. | |
| 5,188,152 | A | 2/1993 | Ogawa | |
| 5,208,090 | A | 5/1993 | Okitsu et al. | |
| 5,213,148 | A | 5/1993 | Masumoto et al. | |
| 5,226,652 | A | 7/1993 | Sato | |
| 5,255,918 | A | 10/1993 | Anderson et al. | |
| 5,261,663 | A | 11/1993 | Anderson et al. | |
| 5,261,664 | A | 11/1993 | Anderson | |
| 5,266,027 | A | 11/1993 | Kuwayama et al. | |
| 5,288,344 | A | 2/1994 | Peker et al. | |
| 5,344,140 | A | 9/1994 | Anderson | |
| 5,368,659 | A | 11/1994 | Peker et al. | |
| 5,417,419 | A | 5/1995 | Anderson et al. | |
| 5,421,724 | A | 6/1995 | Facco et al. | |
| 5,431,396 | A | 7/1995 | Shieh et al. | |
| 5,564,994 | A | 10/1996 | Chang et al. | |
| 5,711,363 | A | 1/1998 | Scruggs et al. | |
| 5,740,854 | A | 4/1998 | Inoue et al. | |
| 5,896,642 | A | 4/1999 | Peker et al. | |
| 6,162,130 | A | 12/2000 | Masumoto et al. | |
| 6,267,170 | B1 | 7/2001 | Onuki et al. | |
| 6,267,171 | B1 | 7/2001 | Onuki et al. | |
| 6,481,088 | B1 * | 11/2002 | Inoue | A63B 53/04 164/495 |
| 6,685,577 | B1 | 2/2004 | Scruggs et al. | |
| 6,709,536 | B1 | 3/2004 | Kim et al. | |
| 7,086,963 | B1 * | 8/2006 | Onuki | A63B 53/04 473/342 |
| 7,090,733 | B2 | 8/2006 | Munir et al. | |
| 7,357,731 | B2 * | 4/2008 | Johnson | A63B 53/04 473/345 |
| 8,066,827 | B2 | 11/2011 | Demetriou | |
| 9,085,814 | B2 * | 7/2015 | Na | C22C 1/002 |
| 2009/0110955 | A1 * | 4/2009 | Hartmann | B23K 1/0012 428/684 |
| 2014/0116579 | A1 | 5/2014 | Na et al. | |

FOREIGN PATENT DOCUMENTS

| | | | |
|---|---|---|---|
| JP | 08109419 | A | 4/1996 |
| JP | 2016508546 | A | 3/2016 |
| WO | 9856523 | A1 | 12/1998 |
| WO | 2004007033 | A1 | 1/2004 |
| WO | 2012047651 | A2 | 4/2012 |
| WO | 2014120788 | A2 | 8/2014 |

OTHER PUBLICATIONS

International Search Report and Written Opinion for International Application No. PCT/US2014/013625, Completed May 5, 2014, dated May 15, 2014, 5 pgs.

Bruck et al., "Quasi-Static Constitutive Behavior of $Zr_{41.25}Ti_{1.75}Ni_{10}Be_{12.5}$ Bulk Amorphous Alloys", Scripta Metallurgica et Materialia, 1994, vol. 30, pp. 429-434.

Inoue et al., "Mg-Cu-Y Bulk Amorphous Alloys with High Tensile Strength Produced by a High-Pressure Die Casting Method", Materials Transaction, JIM, 1992, vol. 33, No. 10, pp. 937-945.

Inoue et al., "Production of Amorphous Cylinder and Sheet of $La_{55}Al_{25}Ni_{20}$ Alloy by a metallic Mold Casting Method", Materials Transactions, JIM, 1990, vol. 31, No. 5, pp. 425-428.

Kawashima et al. "Fracture Toughness of $Zr_{55}Al_{10}Ni_5Cu_{30}$ Bulk Metallic Glass by 3-Point Bend Testing," 2005, vol. 46, No. 7, pp. 1725-1732.

Louzguine-Luzgin, "Mechanical Properties and Deformation Behavior of Bulk Metallic Glasses," Metals, 2013, vol. 3, pp. 1-22.

Peker et al., "A highly processable metallic glass: $Zr_{41.2}Ti_{13.8}Cu_{12.5}Ni_{10.0}Be_{22.5}$", Appl. Phys. Lett., Oct. 25, 1993, vol. 63, No. 17, pp. 2342-2344.

Suh, "Fracture Toughness Study on Bulk Metallic Glasses and Novel Joining Method Using Bulk Metallic Glass Solder," Thesis, 48 pgs.

Zhang et al., "Amorphous Zr—Al—Tm (Tm=Co, Ni, Cu) Alloys with Significant Supercooled Liquid Region of Over 100K", Materials Transactions, JIM, 1991, vol. 32, No. 11, pp. 1005-1010.

Johnson et al., "A Universal Criterion for Plastic Yielding of Metallic Glass with a $T/Tg^{2/3}$ Temperature Dependence", Physical Review Letters, vol. 95, Nov. 4, 2005, pp. 195501-1-195501-4.

Murakami, "Stress Intensity Factors Handbook", vol. 2. Oxford (United Kingdom): Pergamon Press; 1987. 11 pgs. p. 666 in particular.

* cited by examiner

GOLF CLUB FABRICATED FROM BULK METALLIC GLASSES WITH HIGH TOUGHNESS AND HIGH STIFFNESS

CROSS-REFERENCE TO RELATED APPLICATIONS

The application claims priority and benefit to U.S. Provisional Patent Application No. 61/757,979, filed Jan. 29, 2013, and to U.S. Provisional Patent Application No. 61/778,965, filed Mar. 13, 2013, both of which are incorporated herein by reference.

FIELD OF THE INVENTION

The present disclosure is directed to golf clubs formed from bulk-solidifying amorphous metals (i.e., metallic glasses) with high elastic modulus and fracture toughness, and methods of manufacturing the same.

BACKGROUND

The design and performance of golf clubs is greatly influenced by the choice of materials from which they are fabricated. It has been recognized that bulk-solidifying amorphous metals (i.e., metallic glasses) as a class of materials possess certain inherent attributes such as high strength and hardness, high elastic strain limit, and material density varying over a useful range, that make them highly attractive for use various golf clubs including drivers, fairway woods, irons, and putters. Specifically, Scruggs et al. (U.S. Pat. No. 6,685,577) and Johnson et al. (U.S. Pat. No. 7,357,731) have described the benefits arising from these inherent properties of bulk-solidifying amorphous metals in the design and performance of such golf clubs. For example, both Scruggs et al. and Johnson et al. claimed in these patents that the high elastic strain limit of metallic glasses can be potentially exploited to design a golf driver with an exceptionally high coefficient of energy restitution, thereby enabling the golfer to achieve greater distance on a drive. It was also conjectured that the high strength of metallic glass would permit the design of golf irons in which the mass of the club can be concentrated to a greater extent on the perimeter of the iron. It was thought that such design freedom would allow for a club that was more resistant to the "hooking" or "slicing" that occurs when a ball is struck off the "sweet spot" of the club.

In practice, the actual use of metallic glasses in golf clubs has been limited and constrained by other key material properties of available metallic glass materials. Examples of other important properties include elastic stiffness (Young's Modulus}, fracture toughness (notch toughness), ductility under bending, endurance under cyclic loading (fatigue behavior), and general tendency toward brittle catastrophic failure. These properties were not considered as relevant to the design of golf clubs in the prior art, however, the lack of low cost metallic glasses with appropriate combinations of high elastic strain limit, high strength, and density in a useful range together with adequately high values for the aforementioned additional properties has limited the wide-spread adoption of metallic glasses in the golf industry by club designers and engineers. Specifically, the use of metallic glasses in commercial golf clubs has been constrained by the absence of low cost, processable metallic glasses with high modulus, high fracture toughness, high fatigue endurance, adequate bend ductility, and material density in a useful range.

BRIEF SUMMARY OF THE INVENTION

The present disclosure provides golf clubs formed from bulk-solidifying amorphous metals (i.e., metallic glasses) having high elastic modulus and fracture toughness, and to methods of forming the same.

In some embodiments the disclosure is directed to a golf club, where at least a portion of the golf club is formed from a metallic glass having a Young's modulus greater than 120 GPa, and a notch toughness, defined as the stress intensity factor at crack initiation when measured on a 3 mm diameter rod containing a notch with length ranging from 1 to 2 mm and root radius ranging from 0.1 to 0.15 mm, of at least 50 MPa-m$^{1/2}$, and wherein the metallic glass is capable of being formed into an object having a lateral dimension of at least 1 mm.

In some such embodiments, the metallic glass has a Young's modulus greater than 120 GPa, and a notch toughness, defined as the stress intensity factor at crack initiation when measured on a 3 mm diameter rod containing a notch with length ranging from 1 to 2 mm and root radius ranging from 0.1 to 0.15 mm, of at least 70 MPa-m$^{1/2}$.

In other such embodiments, the metallic glass has a Young's modulus greater than 120 GPa, and a notch toughness, defined as the stress intensity factor at crack initiation when measured on a 3 mm diameter rod containing a notch with length ranging from 1 to 2 mm and root radius ranging from 0.1 to 0.15 mm, of at least 90 MPa-m$^{1/2}$.

In other embodiments, the metallic glass has a notch toughness, defined as the stress intensity factor at crack initiation when measured on a 3 mm diameter rod containing a notch with length ranging from 1 to 2 mm and root radius ranging from 0.1 to 0.15 mm, greater than $\sigma_Y(0.3\pi t)^{1/2}$, where $\sigma_Y$ is the compressive yield strength of the metallic glass and t is the thickness of the metallic glass portion subject to bending load.

In still other embodiments, the metallic glass has at least one additional property, selected from the group consisting of: a mass density between 4.0 g/cc and 9 g/cc, a shear modulus of less than 55 GPa, a bulk modulus of at least 170 GPa, a Poisson's ratio of at least 0.35, a compressive yield strength of at least 2.0 GPa, an elastic strain limit of at least 1.4%, a plastic zone radius estimated as ($K_Q^2/\pi\sigma_Y^2$), where $\sigma_Y$ is the compressive yield strength of the metallic glass and $K_Q$ is the notch toughness, defined as the stress intensity factor at crack initiation when measured on a 3 mm diameter rod containing a notch with length ranging from 1 to 2 mm and root radius ranging from 0.1 to 0.15 mm, of at least 0.25 mm, an ability to sustain permanent plastic bending strain (in a 3-point bend test) of at least 1% in a sample having a thickness subject to bending load of at least 1 mm, and having a critical rod diameter of at least 3 mm diameter or critical plate thickness of at least 1 mm.

In some such embodiments the metallic glass has at least two additional properties, selected from the group consisting of: a mass density between 4.0 g/cc and 9 g/cc, a shear modulus of less than 55 GPa, a bulk modulus of at least 170 GPa, a Poisson's ratio of at least 0.35, a compressive yield strength of at least 2.0 GPa, an elastic strain limit of at least 1.4%, a plastic zone radius estimated as ($K_Q^2/\pi\sigma_Y^2$), where $\sigma_Y$ is the compressive yield strength of the metallic glass and $K_Q$ is the notch toughness, defined as the stress intensity factor at crack initiation when measured on a 3 mm diameter rod containing a notch with length ranging from 1 to 2 mm and root radius ranging from 0.1 to 0.15 mm, of at least 0.25 mm, an ability to sustain permanent plastic bending strain (in a 3-point bend test) of at least 1% in a sample having a thickness subject to bending load of at least 1 mm, and having a critical rod diameter of at least 3 mm diameter or critical plate thickness of at least 1 mm.

In still other such embodiments, the metallic glass has a mass density between 4.0 g/cc and 9 g/cc, a shear modulus of less than 55 GPa, a bulk modulus of at least 170 GPa, a Poisson's ratio of at least 0.35, a compressive yield strength of at least 2.0 GPa, an elastic strain limit of at least 1.4%, a plastic zone radius estimated as $(K_Q^2/\pi\sigma_Y^2)$, where $\sigma_Y$ is the compressive yield strength of the metallic glass and $K_Q$ is the notch toughness, defined as the stress intensity factor at crack initiation when measured on a 3 mm diameter rod containing a notch with length ranging from 1 to 2 mm and root radius ranging from 0.1 to 0.15 mm, of at least 0.25 mm, an ability to sustain permanent plastic bending strain (in a 3-point bend test) of at least 1% in a sample having a thickness subject to bending load of at least 1 mm, and having a critical rod diameter of at least 3 mm diameter or critical plate thickness of at least 1 mm.

In yet other embodiments, the metallic glass is given by the formula:

$$X_{100-a-b}Y_aZ_b$$

where: X is Ni, Fe, Co or combinations thereof; Y is Cr, Mo, Mn, Nb, Ta or combinations thereof; Z is P, B, Si or combinations thereof; a is between 5 and 15 at %; and b is between 15 and 25 at %.

In some such embodiments the metallic glass may include one or more of the following elements in concentrations of up to 3 at %: W, Ru, Re, Cu, Pd, Pt, V, Sn.

In still yet other embodiments, the metallic glass is given by the formula:

$$Ni_{100-a-b-c}W_aY_bZ_c$$

where: W is Co, Fe, or combinations thereof; Y is Cr, Mo, Mn, Nb, Ta or combinations thereof; Z is P, B, Si or combinations thereof; a is up to 40 at %; b is between 5 and 15 at %; and c is between 15 and 25 at %.

In yet other embodiments, the metallic glass is given by the formula:

$$Ni_{100-a-b-c}Cr_aY_aZ_c$$

where: Y is Mo, Mn, Nb, Ta or combinations thereof; Z is P, B, Si or combinations thereof; a is between 5 and 10 at %; b is between 2.5 and 5 at %, and c is between 15 and 25 at %.

In still yet other embodiments, the metallic glass is given by the formula:

$$Ni_{100-a-b-c-d}Cr_aY_bP_cZ_d$$

where: Y is Mo, Mn, Nb, Ta, or combinations thereof; Z is B, Si or combinations thereof; a is between 5 and 10 at %; b is between 2.5 and 5 at %, c is between 16 and 19 at %, and d is between 1 and 3.5 at %.

In still yet other embodiments, the metallic glass is capable of being formed into an object having a lateral dimension of at least 3 mm.

In still yet other embodiments, the metallic glass is selected from the group consisting of: $Ni_{71.4}Cr_{5.52}Nb_{3.38}P_{16.67}B_{3.03}$, $Ni_{72.5}Cr_5Nb_3P_{16.5}B_3$; $Ni_{70.75}Cr_7Ta_{2.75}P_{16.25}B_{3.25}$ $Ni_{6.9}Cr_{7.5}Mn_3Mo_1P_{16.5}B_3$, $Ni_{69.9}Co_{1.5}Cr_{5.52}Nb_{3.38}P_{16.67}B_{3.03}$, $Ni_{67.1}Cr_{10}Nb_{3.4}P_{18}Si_{1.5}$, $Ni_{74}Mn_{3.5}Nb_3P_{16.5}B_3$, and $Ni_{72.3}Mo_3Nb_4Mn_1P_{16.5}B_{3.2}$, In other embodiments the disclosure is directed to methods of forming at least one portion of a golf club from a metallic glass, the method including:

selecting and melting an alloy capable of forming a metallic glass having a Young's modulus greater than 120 GPa, and a notch toughness, defined as the stress intensity factor at crack initiation when measured on a 3 mm diameter rod containing a notch with length ranging from 1 to 2 mm and root radius ranging from 0.1 to 0.15 mm, of at least 50 MPa-m$^{1/2}$, and wherein the metallic glass is capable of being formed an bulk object having a lateral dimension of at least 1 mm, forming the alloy melt to fabricate at least one portion of the golf club; and quenching the formed alloy melt at a cooling rate sufficiently rapid to prevent crystallization of the alloy to form at least one portion of a golf club from the metallic glass.

In other embodiments the method further includes fluxing the molten alloy prior to quenching by using a reducing agent.

In still other embodiments the step of melting the alloy comprising heating the alloy melt at a temperature of at least 100° C. above the liquidus temperature of the alloy.

In yet other embodiments the step of melting the alloy comprising heating the alloy melt at a temperature of at least 1100° C.

In still yet other embodiments the metallic glass has at least one additional property, selected from the group consisting of a mass density between 4.0 g/cc and 9 g/cc, a shear modulus of less than 55 GPa, a bulk modulus of at least 170 GPa, a Poisson's ratio of at least 0.35, a compressive yield strength of at least 2.0 GPa, an elastic strain limit of at least 1.4%, a plastic zone radius estimated as $(K_Q^2/\pi\sigma_Y^2)$, where $\sigma_Y$ is the compressive yield strength of the metallic glass and $K_Q$ is the notch toughness, defined as the stress intensity factor at crack initiation when measured on a 3 mm diameter rod containing a notch with length ranging from 1 to 2 mm and root radius ranging from 0.1 to 0.15 mm, of at least 0.25 mm, an ability to sustain permanent plastic bending strain (in a 3-point bend test) of at least 1% in a sample having a thickness subject to bending load of at least 1 mm, and having a critical rod diameter of at least 3 mm diameter or critical plate thickness of at least 1 mm.

In still yet other embodiments metallic glass is given by the formula:

$$X_{100-a-b}Y_aZ_b$$

where: X is Ni, Fe, Co or combinations thereof; Y is Cr, Mo, Mn, Nb, Ta or combinations thereof; Z is P, B, Si or combinations thereof; a is between 5 and 15 at %; and b is between 15 and 25 at %.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and data, which forms a part of this disclosure.

BRIEF DESCRIPTION OF THE DRAWINGS

These and other features and advantages of the present invention will be better understood by reference to the following detailed description when considered in conjunction with the accompanying figures and data, wherein.

DETAILED DESCRIPTION OF THE INVENTION

Figure 1:
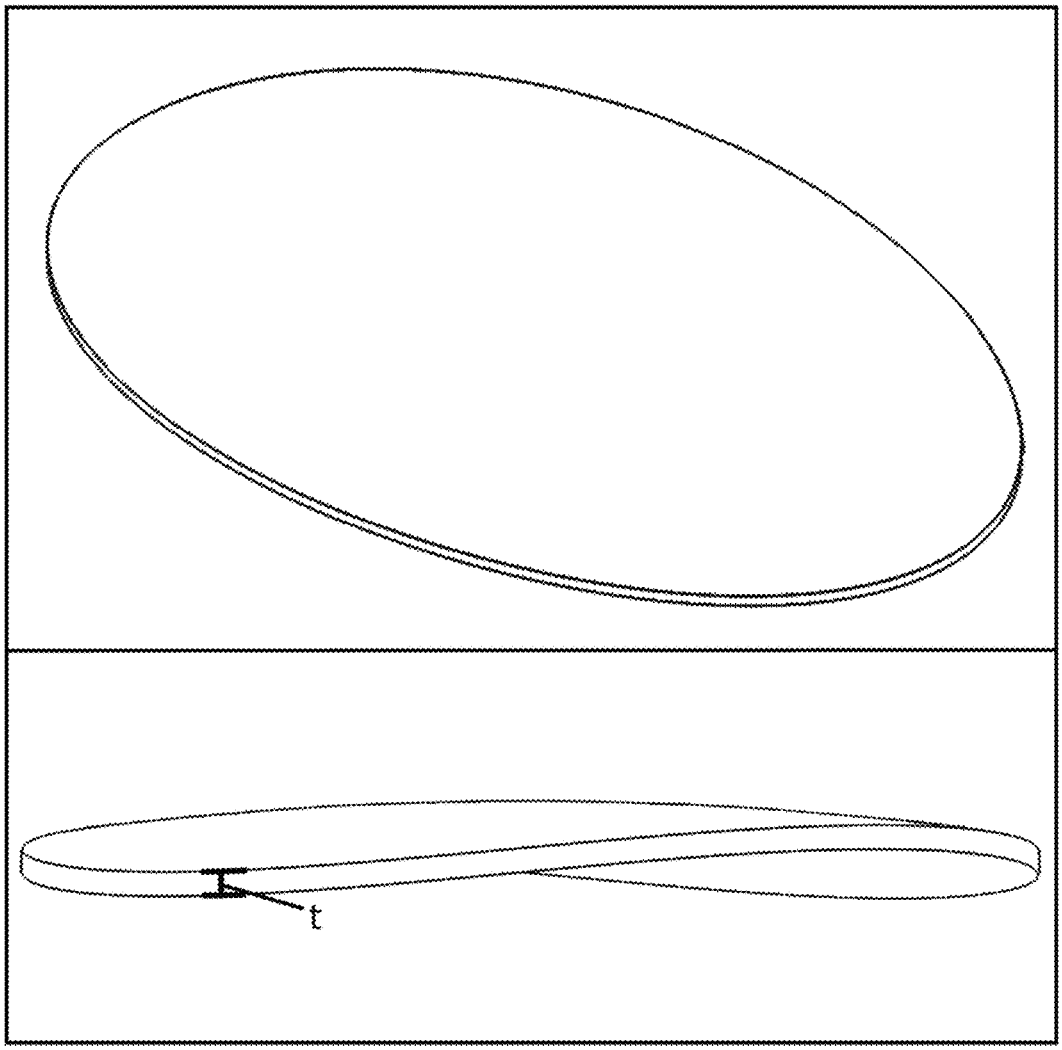
FIG. 1 provides a schematic of a striking face of a golf club, with the thickness t designated.

The present disclosure may be understood by reference to the following detailed description, taken in conjunction with the data as described below.

Description of the Golf Clubs

The present disclosure provides golf clubs comprising at least one part formed from a shaped metallic glass having at least a high elastic modulus and fracture toughness, and to methods of forming the same.

In some embodiments, the disclosure is directed to a golf club fabricated from a metallic glass having a Young's modulus Y>120 GPa, and a notch toughness $K_Q$ of at least 50 MPa-m$^{1/2}$; in some embodiments a $K_Q$ is at least 70 MPa-m$^{1/2}$, and in some embodiments $K_Q$ is at least 90 MPa-m$^{1/2}$. In other embodiments, the club comprises at least one portion fabricated from a metallic glass having a Young's modulus Y>120 GPa, and a notch toughness ($K_Q$) greater than $\sigma_Y(0.3\pi t)^{1/2}$, where $\sigma_Y$ is the metallic glass yield strength and t is the thickness of the metallic glass portion subject to bending load.

In some embodiments, the golf clubs of the disclosure may also include properties of the metallic glass such as the elastic strain, the yield strength, the notch toughness, the plastic zone radius, the plastic bending strain, and the critical casting thickness within specified ranges. In some such embodiments the golf clubs of the disclosure comprise at least one part fabricated from a bulk metallic glass having a Young's modulus Y>120 GPa, a notch toughness $K_Q$ of at least 50 MPa-m$^{1/2}$, and at least one additional property, in other embodiments at least two additional properties, and in still other embodiments all of the properties selected from the group consisting of: a mass density ρ between 4.0 g/cc and 9.0 g/cc, a shear modulus (or modulus of rigidity) G of less than 55 GPa, a bulk modulus B of at least 170 GPa, a Poisson's ratio v of at least 0.35, a compressive yield strength $\sigma_Y$ of at least 2.0 GPa, an elastic strain limit $\varepsilon_Y$ of at least 1.4%, a plastic zone radius estimated as $((K_Q^2/\pi\sigma_Y^2)$, where $\sigma_Y$ is the compressive yield strength of the metallic glass and $K_Q$ is the notch toughness, defined as the stress intensity factor at crack initiation when measured on a 3 mm diameter rod containing a notch with length ranging from 1 to 2 mm and root radius ranging from 0.1 to 0.15 mm of at least 0.25 mm, an ability to sustain permanent plastic bending strain (in a 3-point bend test) of at least 1% in a sample having thickness subject to bending load of at least 1 mm, and having a critical rod diameter $d_{cr}$ of at least 3 mm or a critical plate thickness at least 1 mm.

In some embodiments, the disclosure is directed to any portion of the head of the golf club, including striking head and/or body.

In certain embodiments of the present disclosure, the glass-forming ability of an alloy is quantified by the "critical rod diameter", defined as maximum rod diameter in which the amorphous phase can be formed by quenching the high temperature melt state. In other embodiments, the glass-forming ability of an alloy is quantified by the "critical plate thickness", defined as maximum plate thickness in which the amorphous phase can be formed by quenching the high temperature melt state.

In the present disclosure, the "notch toughness" is defined as the stress intensity factor at crack initiation $K_Q$, and is the measure of the material's ability to resist fracture in the presence of a notch. The notch toughness is a measure of the work required to propagate a crack originating from a notch. A high $K_Q$ ensures that the material will be tough in the presence of defects.

The "yield strength, $\sigma_Y$, is defined as the stress at which the material yields plastically. A high yield strength ensures that the material will be strong. In the present disclosure, the yield strength is assumed to be the compressive yield strength, which a measure of the material's ability to resist non-elastic yielding under compression.

The Young's modulus is a measure of the material's elastic response to uniaxial stress. A high Young's modulus ensures that the material will be stiff under uniaxial stress.

The shear modulus is a measure of the material's elastic response to shear stress. A low shear modulus ensures that the material will be compliant to shear stress.

The bulk modulus is a measure of the material's elastic response to hydrostatic stress. A high bulk modulus ensures that the material will be resistant to hydrostatic stress.

The Poisson's ratio is a measure of the material's ability to elastically accommodate stress by shear rather than hydrostatically. A high Poisson's ratio ensures that the material will preferentially deform by shear rather than hydrostatically.

The "bending ductility" is a measure of the material's ability to resist fracture in bending in the absence of a notch or a pre-crack.

In many particular embodiments, the golf clubs of the disclosure comprise at least one part fabricated from a bulk-solidifying amorphous metal having the following formula:

$$X_{100-a-b}Y_aZ_b$$

where: X is Ni, Fe, Co or combinations thereof; Y is Cr, Mo, Mn, Nb, Ta or combinations thereof; Z is P, B, Si or combinations thereof; a is between 5 and 15 at %; and b is between 15 and 25 at %; and where the bulk-solidifying amorphous metal has at least the elastic modulus and fracture toughness properties described above.

Derivation of Material Property Thresholds or Figures of Merit

In determining suitable bulk-solidifying amorphous metals and suitable material properties for such bulk-solidifying amorphous metals, it is necessary to consider the construction of the golf club itself.

In some embodiments, the present disclosure is directed to the striking face of the golf club. The striking face of a golf club, such as a driver or iron, can be considered a two dimensional flexural membrane. A schematic of a striking face of a golf club is presented in FIG. 1. In the case of a driver or wood-type clubs, the membrane is often designed with curvature, which may vary along the principal directions lying in plane of the membrane. The membrane may be of uniform or variable thickness (in the direction normal to the face of the club). A uniform thickness t is designated in the example striking face of FIG. 1. As described above, one can consider several material "figures of merit" or "thresholds" which may be used in the engineering design of a high performance golf club. Ultimately, these material "figures of merit" or "thresholds" help to determine the achievable performance of the golf club.

In the case of a driver, one widely recognized performance benchmark is the coefficient of energy restitution, COR, of the driver as measured during impact with a golf ball. The COR can be directly related to the amount of elastic energy E stored in the supported striking membrane during its collision with the ball. With simplifying assumptions, this can be given by:

$$E = \frac{3W^2a^2(462)}{8\pi Yt^3} \quad \text{(EQ. 1)}$$

where W is the maximum force exerted on the striking face during the collision, a is the average "radius" of the membrane and t its thickness (the striking face is approximated as a circular disk for simplicity). In practice, t has a minimum value determined by the material properties of the plate. The minimum value of t which could sustain the impact without collapse for a striking face of dimension a>>t it given by:

$$t_{min} = \left[\frac{\pi W}{2\sigma_y}\right]^{1/2} \quad \text{(EQ. 2)}$$

where $\sigma_y$ is the yield strength of the material. Using a maximum force W~4000 N (typical of impact with a high club swing speed of 120 mph) yields a maximum value, $E_{MAX}$, of stored elastic energy in the striking membrane of:

$$E_{MAX} = \frac{(0.177)a^2\sigma^{\frac{3}{2}}}{Y} = 0.177a^2\varepsilon_y^{3/2}Y^{1/2} \quad \text{(EQ. 3)}$$

where $\varepsilon_Y=\sigma_Y/Y$ is the elastic strain limit (in uniaxial loading) of the material and Y is elastic modulus of the material (Young's Modulus). This result establishes a "figure of merit" (FOM) for high performance drivers and shows that this FOM scales: (1) with the membrane size as "$a^2$", (2) the three-halves power of elastic strain limit of the material, $\varepsilon_Y^{3/2}$, and (3) the square root of the elastic modulus $Y^{1/2}$. Accordingly, substituting $\varepsilon_y=0.014$ and $Y=120*10^9$ Pa into Eq. 3, yields a proportionality constant relating the stored elastic energy E to the square of the average radius of the striking face $a^2$ (in units of centimeters) of greater than 101.

Since all metallic glasses have been shown to have a large and nearly universal elastic strain limit (See, Johnson W. L. and Samwer K., "A Universal Criterion for Plastic Yielding of Metallic Glasses with a $T/Tg^{2/3}$ Temperature Dependence," Physical Review Letters 95, 195501 (2005), the disclosure of which is incorporated herein by reference) of $\varepsilon_Y=0.014$-$0.022$, which is much larger than that of conventional crystalline metals (where $\varepsilon_Y<0.01$), while Y is typically similar to that of corresponding crystalline metals, it follows that metallic glasses should be superior to conventional crystalline metals for the design of high COR golf clubs. It demonstrates, in particular, the importance of both Y and $\varepsilon_Y$ in determining the performance drivers using metallic glass materials. Furthermore, as will be seen below, choosing a material with high $\varepsilon_Y$ and Y alone is not sufficient for achieving the $E_{MAX}$ predicted by EQ. 3.

Nor was the result summarized in the discussion above anticipated by prior attempts to fabricate golf clubs from bulk-solidifying amorphous metals (such as those described in Scruggs et al. and Johnson et al., cited above). In practice, attempts to fabricate high COR drivers from bulk-solidifying amorphous metals for the golf market have been plagued by other inherent properties of available metallic glasses that are inadequate for this application. Most notably, when designed for high COR, a metallic glass driver face may exhibit unacceptable brittle and catastrophic failure (shattering) during impact with a golf ball. The failure may happen after one or several impacts, or following many impacts (cycles). Typically, a commercial golf club is qualified for durability by testing to ~3,000 cycles of impact and must not fail catastrophically.

Accordingly, to avoid unacceptable catastrophic brittle failure and to ensure sufficient durability demands a face material with both: (1) sufficient fracture toughness, $K_Q$, and (2) sufficient endurance limit, $\sigma_o$, following thousands of fatigue cycles. Here the endurance limit, $\sigma_o$, is defined as the applied stress amplitude level at which the material fails after ~3,000 loading cycles. In general $\sigma_o<\sigma_Y$. The applied stress amplitude, $\sigma_o$, is defined as $(\sigma^{max}-\sigma_{min})/2$, where $\sigma_{max}$ and $\sigma_{min}$ are the maximum and minimum stresses experienced during the loading cycle.

For a high modulus metallic glass with $\varepsilon_Y=0.014$-$0.022$ and Y>120 GPa, brittle failure must be avoided under both single and multiple loadings up to thousands of impact events. Experimentally, metallic glass plates of thickness t on the order of 1 mm subjected to bending loads yield plastically (plastically collapse) and do not fracture in a brittle manner if the fracture toughness $K_Q$ is sufficiently large, and the yield strength is not exceedingly high. Empirically, we find that to avoid brittle fracture under overloading:

$$R_P=(K_Q^2/\pi\sigma_Y^2)=K_Q^2/(\pi\varepsilon_Y^2Y^2)>0.3t$$

or $$K_Q>(0.3\pi t)^{1/2}\sigma_y \quad \text{(EQ. 4)}$$

where the factor 0.3 is approximate and is obtained empirically from experiments. Taking a metallic glass with Y=130 GPa, $\varepsilon_y=0.018$, and t=~2 mm typical of a high COR striking membrane, one obtains the requirement:

$$K_Q\approx 90 \text{ MPa-m}^{1/2} \quad \text{(EQ. 5)}$$

Taken together with the requirement that Y>120 GPa, the material requirement of $K_Q\approx 90$ MPa-$m^{1/2}$ is demanding. Typically, Y and $K_Q$ in bulk metallic glasses are mutually exclusive. Specifically, bulk metallic glasses exhibiting high Y (higher than about 120 GPa) typically demonstrate low $K_Q$ (lower than 50 MPa·$m^{1/2}$). Conversely, bulk metallic glasses that demonstrate high $K_Q$ (higher than 50 MPa·$m^{1/2}$) typically exhibit low Y (lower than about 100 GPa). It is therefore not clear that a bulk metallic glass could exhibit both a high Y and a high $K_Q$.

Figure 2:
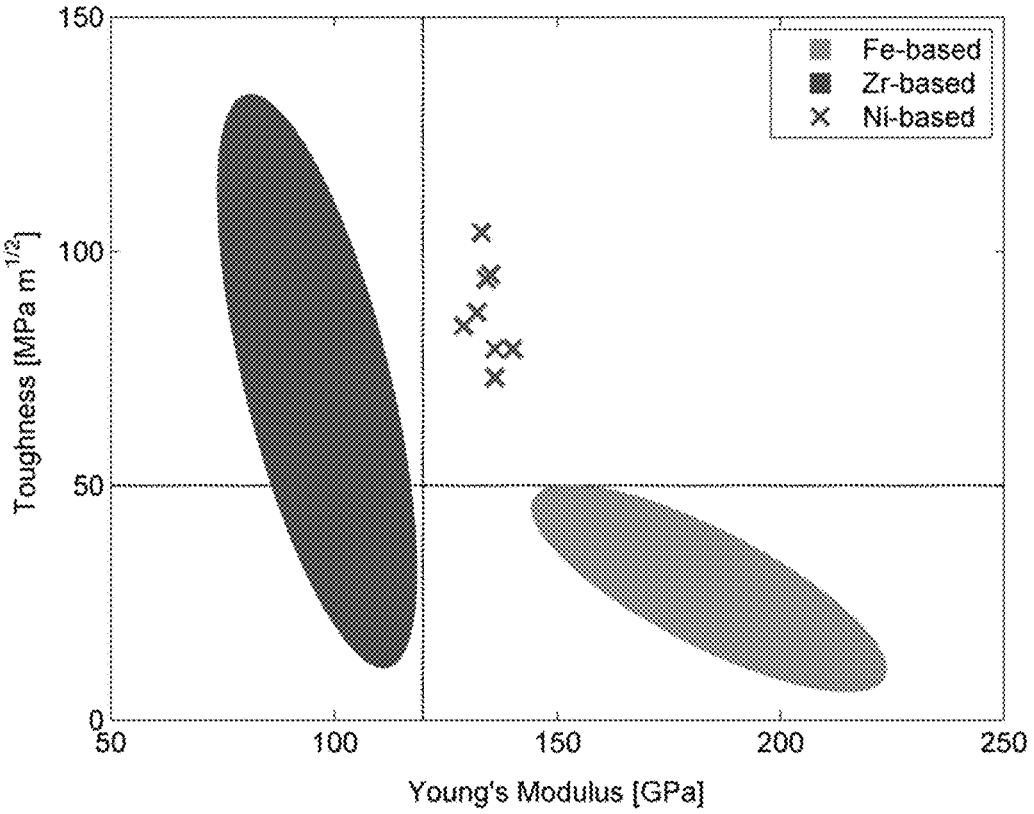
FIG. 2 provides a data plot of toughness vs. Young's modulus for Zr-based, Fe-based, and example Ni-based metallic glasses.

FIG. 2 provides a data plot of toughness vs. Young's modulus for Zr-based and Fe-based metallic glass alloys. These are two alloy families that demonstrate adequate glass forming ability and have cost structures that would permit fabrication of golf clubs components. The data represent metallic glasses with critical rod diameters in excess of 3 mm. The toughness data represent measurements performed with notches not exceeding 0.15 mm in root radius. As shown in the plot. Zr-based glasses can have toughness values as high as 150 MPa $m^{1/2}$, but their Young's modulus is limited to below 120 GPa. By contrast, Fe based glasses can have Young's moduli in excess of 200 GPa, but their toughness is limited to about 50 MPa $m^{1/2}$.

The role of fatigue and durability requirements in the design and performance of the high COR golf club can be assessed by replacing $\sigma_Y$ by $\sigma_o$ in EQ. 2 for $E_{MAX}$. In effect, one must reduce the usable strength of the material by a factor, $r=\sigma_o/\sigma_Y$ to avoid fatigue induced brittle fracture after ~3000 cycles of loading. For bulk metallic glasses in high cycle fatigue, (i.e. $10^7$ cycles), r varies considerably and ranges from 0.05 to 0.3, whereas for an intermediate number of $10^4$ cycles, r is greater and ranges from 0.2 to 0.6. It is noted that for conventional crystalline metals, the corresponding r factor falls in a similar range. For a bulk metallic glass (or conventional metal) of given Y, $t_{min}$ is increased by a factor of $r^{1/2}$ (as seen in EQ. 2), while $E_{MAX}$ is reduced by a factor of $r^{3/2}$ (as seen in EQ. 3). The value of $K_Q$ required to avoid brittle failure during loading to $\sigma_o$ in a single cycle will be reduced by a factor of $r^{1/2}$ (as can be seen in from EQ. 4). In effect, the thicker membrane is never loaded to the point where it yields plastically. It is now designed for maximum COR subject to passing a durability test. For Y=130 GPa, and r=0.5-0.6 (the value for a fatigue resistant bulk metallic glass), the required $K_Q$ of the metallic glass becomes:

$$K_Q > r^{1/2}(90\ \text{MPa-m}^{1/2}) = 70\text{-}75\ \text{MPa-m}^{1/2} \quad \text{(EQ. 6)}$$

In some embodiments, metallic glass materials having a minimum $K_Q$ of 50 MPa-$m^{1/2}$ are claimed. This minimum fracture toughness is a highly demanding material requirement for a metallic glass of high modulus (Y).

Exemplary Metallic Glasses

As discussed above, it has been discovered that to make high COR golf clubs from bulk-solidifying amorphous metals, it is necessary to use metallic glasses having a combination of material properties that are generally considered mutually exclusive. In particular, the metallic glass should have a high modulus (Y), and also a high fracture toughness ($K_Q$). In FIG. 2, data for example Ni-based metallic glasses that that have been discovered to have these demanding properties, and which can also be cast in bulk form (millimeters thick), are plotted. Below examples of such metallic glass alloys are provided.

The present inventors have recently developed a novel family of metallic glasses (See, U.S. patent application Ser. No. 14/067,521, entitled "Bulk Nickel-Based Chromium and Phosphorous Bearing Metallic Glasses with High Toughness", filed on Oct. 30, 2013, which is incorporated herein by reference). This metallic glass family is based on relatively low cost ferrous metals (Ni based bearing Cr) that have a unique combination of high elastic modulus (Y~125-140 GPa), high notch toughness ($K_Q$~60-100 MPa-$m^{1/2}$), combined with the ability to sustain plastic bending of plates, beams, and rods of relevant thickness for the design of golf clubs (t~1-2 mm). Further, it has been demonstrated that the glass forming ability, high toughness, and bending ductility depend critically on how the material is processed. Based on their mechanical properties and the correlation of properties with processing, it is expected that with suitable processing, these metallic glasses can be used to design and manufacture golf clubs possessing superior performance.

Hence, certain novel bulk metallic glass alloys based on Ni bearing transition metals like Cr, Nb, Ta, Mn, and Mo and metalloids like Si, B, and P can have high elastic modulus (Young's Modulus) (Y>120 GPa), large elastic strain limits ($\varepsilon_Y$~2%), high notch toughness ($K_Q$>50 MPa·$m^{1/2}$), and can sustain ductile bending, as opposed to brittle fracture, when fabricated in rods, plates or beams of thickness (or diameter) below 2 mm. Moreover, these bulk glass forming alloys can exhibit excellent glass forming ability and can be cast to form fully glassy cast rods of at least 3 mm and often greater than 10 mm in diameter. Their density is typically comparable to or less than that of steels (7.8-8.2 g/cc). The glassy alloys can further exhibit excellent corrosion resistance (often exceeding that of stainless steels) making them durable and resistant to environmental degradation.

This family of bulk glass forming alloys and bulk metallic glasses may be generally described by the following formula:

$$X_{100-a-b}Y_aZ_b$$

where: X is Ni, Fe, Co or combinations thereof; Y is Cr, Mo, Mn, Nb, Ta or combinations thereof; Z is P, B, Si or combinations thereof; a is between 5 and 15 at %; and b is between 15 and 25 at %.

In other embodiments bulk glass forming alloys and bulk metallic glasses may be generally described by the following formula:

$$Ni_{100-a-b-c}W_aY_bZ_c$$

where: W is Co, Fe, or combinations thereof; Y is Cr, Mo, Mn, Nb, Ta or combinations thereof; Z is P, B, Si or combinations thereof; a is up to 40 at %; b is between 5 and 15 at %; and c is between 15 and 25 at %.

In other embodiments bulk glass forming alloys and bulk metallic glasses may be generally described by the following formula:

$$Ni_{100-a-b-c}Cr_aY_bZ_c$$

where: Y is Mo, Mn, Nb, Ta or combinations thereof; Z is P, B, Si or combinations thereof; a is between 5 and 10 at %; b is between 2.5 and 5 at %, and c is between 15 and 25 at %.

In other embodiments bulk glass forming alloys and bulk metallic glasses may be generally described by the following formula:

$$Ni_{100-a-b-c-d}Cr_aY_bP_cZ_d$$

where: Y is Mo, Mn, Nb, Ta or combinations thereof; Z is B, Si or combinations thereof; a is between 5 and 10 at %; b is between 2.5 and 5 at %, c is between 16 and 19 at %, and d is between 1 and 3.5 at %.

In still other embodiments, the alloys may include one or more of the following elements in concentrations of up to 3 at %: W, Ru, Re, Cu, Pd, Pt, V, Sn.

Table I, below, provides several examples of such bulk metallic glass forming alloys having properties suitable for use in forming the high COR golf clubs according to embodiments of the disclosure. (The importance of each and the combination of all of these properties to enhance the design and performance of the golf club head being described above).

TABLE I

Exemplary Bulk Metallic Glass Alloys And Properties

| Metallic Glass Property | A* | B* | C* | D* | E* | F* | G* | H* |
|---|---|---|---|---|---|---|---|---|
| Density ρ (g/cc) | 7.9 | 8.0 | 8.2 | 7.8 | 7.8 | 7.9 | 7.9 | 8.1 |
| Shear Modulus G (GPa) | 49 | 49 | 50 | 48 | 48 | 51 | 47 | 49 |
| Bulk Modulus B (GPa) | 178 | 185 | 178 | 175 | 179 | 181 | 179 | 189 |
| Poisson's ratio ν | 0.37 | 0.38 | 0.37 | 0.37 | 0.38 | 0.37 | 0.38 | 0.38 |
| Young's Modulus Y (GPa) | 134 | 135 | 136 | 132 | 133 | 140 | 129 | 136 |
| Yield Strength $\sigma_Y$ (GPa) | 2.38 | 2.31 | 2.43 | 2.28 | 2.29 | 2.50 | 2.22 | 2.43 |
| Elastic Strain Limit $\varepsilon_Y$ (%) | 1.77 | 1.71 | 1.79 | 1.73 | 1.73 | 1.80 | 1.73 | 1.78 |
| Notch Toughness $K_Q$ (MPa · $m^{1/2}$) | 94 | 95 | 79 | 87 | 104 | 79 | 84 | 73 |

TABLE I-continued

Exemplary Bulk Metallic Glass Alloys And Properties

| Metallic Glass Property | A* | B* | C* | D* | E* | F* | G* | H* |
|---|---|---|---|---|---|---|---|---|
| Plastic Zone Radius $R_p$ (mm) | 0.50 | 0.53 | 0.34 | 0.46 | 0.65 | 0.32 | 0.47 | 0.28 |
| Critical rod diameter $d_{cr}$ (mm} | 11 | 6 | 7 | 5 | 9 | 11 | 5 | 5 |

*A: $Ni_{71.4}Cr_{5.52}Nb_{3.38}P_{16.67}B_{3.03}$;
B: $Ni_{72.5}Cr_5Nb_3P_{16.5}B_3$;
C: $Ni_{70.75}Cr_7Ta_{2.75}P_{16.25}B_{3.25}$;
D: $Ni_{69}Cr_{7.5}Mn_3Mo_1P_{16.5}B_3$;
E: $Ni_{69.9}Co_{1.5}Cr_{5.52}Nb_{3.38}P_{16.67}B_{3.03}$;
F: $Ni_{67.1}Cr_{10}Nb_{3.4}P_{18}Si_{1.5}$;
G: $Ni_{74}Mn_{3.5}Nb_3P_{16.5}B_3$;
H: $Ni_{72.3}Mo_3Nb_4Mn_1P_{16.5}B_{3.2}$.

Although specific embodiments of bulk metallic glasses are provided above, it should be understood that this list is meant only to be exemplary and not exhaustive. Other bulk metallic glass alloys based on Ni or based on any other element may also possess the necessary properties and would therefore fall within the scope of this disclosure.

Methods of Forming Metallic Glass Golf Club Portions

Although the above discussion has focused on golf club portions formed from metallic glasses, the disclosure is also directed to methods of forming at least one portion of a golf club from a metallic glass.

In some embodiments, the method includes the steps of:

selecting and melting an alloy capable of forming a metallic glass having the at least one of the sets of properties (including, for example, Young's modulus, notch toughness, elastic strain, yield strength, notch toughness, plastic zone radius, plastic bending strain, critical casting thickness within specified limits, and corrosion resistance) described above wherein the metallic glass is capable of forming an amorphous bulk object having a lateral dimension of at least 1 mm, forming the alloy melt to fabricate at least one portion of the golf club; and quenching the formed alloy melt at a cooling rate sufficiently rapid to prevent crystallization of the alloy to form at least one portion of a golf club from the metallic glass.

In many embodiments, the metallic glass comprises an alloy according to:

$$X_{100-a-b}Y_aZ_b$$

where: X is Ni, Fe, Co or combinations thereof; Y is Cr, Mo, Mn, Nb, Ta or combinations thereof; Z is P, B, Si or combinations thereof; a is between 5 and 15 at %; and b is between 15 and 25 at %. The above formulation should be considered just one exemplary embodiment, and the method may incorporate any of the other materials described herein.

The method may further comprise additional processing as desired to improve the properties of the alloys, including:

Prior to rapidly quenching the melt to form the amorphous part, fluxing the molten alloy prior to quenching by using a reducing agent as described, for example, in U.S. Provisional Patent Application No. 61/866,615, filed Aug. 16, 2013, the disclosure of which is incorporated herein by reference.

Prior to rapidly quenching the melt to form the amorphous part, overheating the alloy by melting the alloy, such as, at a temperature of at least 100° C. above the liquidus temperature of the alloy, or at a temperature of at least 1100° C., as described, for example, in U.S. Provisional Patent Application No. 61/755,177, filed Jan. 22, 2013, the disclosure of which is incorporated herein by reference.

It should be understood that the step of forming the portion of the golf club may constitute any suitable forming method, including, but not limited to, casting from the high temperature melt state, or thermoplastically forming the glass state by extrusion, dynamic forging, stamp forging, blow molding, injection molding, where the heating of the glass state is performed by resistive heating, inductive heating, or joule heating.

Moreover, additional elements may be added to these techniques to improve the quality of the final article. For example, to improve the surface finish of the articles formed in accordance with any of the above shaping methods, the mold or stamp may be heated to around or just below the glass transition temperature of the amorphous material, thereby preventing formation of surface defects. In addition, to achieve articles with better surface finish or net-shape parts, the deformational force, and in the case of an injection molding technique, the injection speed, of any of the above shaping techniques may be controlled to avoid a melt front break-up instability arising from high "Weber number" flows, i.e., to prevent atomization or spraying that lead to the formation of flow lines.

Technical Descriptions

The properties of the alloys listed in Tables 1 & 2 above, are obtained as described below.

Description of Methods of Processing the Sample Alloys

A method for producing the alloys involves inductive melting of the appropriate amounts of elemental constituents in a quartz tube under inert atmosphere. The purity levels of the constituent elements were as follows: Ni 99.995%, Co 99.995%, Cr 99.996%, Mo 99.95%, Nb 99.95%, Ta 99.95%, Mn 99.9998%, P 99.9999%, Si 99.9999%, and B 99.5%. The melting crucible may alternatively be a ceramic such as alumina or zirconia, graphite, sintered crystalline silica, or a water-cooled hearth made of copper or silver.

A particular method for producing metallic glass rods from the alloy ingots involves re-melting the alloy ingots in quartz tubes having 0.5-mm thick walls in a furnace at 1100° C. or higher, and in some embodiments, ranging from 1250° C. to 1400° C., under high purity argon and rapidly quenching in a room-temperature water bath. Alternatively, the bath could be ice water or oil. Metallic glass articles can be alternatively formed by injecting or pouring the molten alloy into a metal mold. The mold can be made of copper, brass, or steel, among other materials.

Optionally, prior to producing an amorphous article, the alloyed ingots may be fluxed with a reducing agent by re-melting the ingots in a quartz tube under inert atmosphere, bringing the alloy melt in contact with the molten reducing agent, and allowing the two melts to interact for about 1000 s at a temperature of 1100° C. or higher, and in some embodiments, at a temperature ranging from 1250° C. to 1400° C., under inert atmosphere and subsequently water quenching. In some embodiments, the reducing agent is boron oxide.

Test Methodology for Measuring Notch Toughness

The notch toughness of sample metallic glasses was performed on 3-mm diameter rods. The rods were notched using a wire saw with a root radius ranging from 0.10 to 0.13 mm to a depth of approximately half the rod diameter. The notched specimens were tested on a 3-point beam configuration with span of 12.7 mm, and with the notched side carefully aligned and facing the opposite side of the center loading point. The critical fracture load was measured by applying a monotonically increasing load at constant cross-head speed of 0.001 mm/s using a screw-driven testing frame. At least three tests were performed, and the variance between tests is included in the notch toughness plots. The stress intensity factor for the geometrical configuration employed here was evaluated using the analysis by Murakimi (Y. Murakami, Stress Intensity Factors Handbook, Vol. 2, Oxford: Pergamon Press, p. 666 (1987)).

Test Methodology for Measuring Compressive Yield Strength

Compression testing of sample metallic glasses was performed on cylindrical specimens 3 mm in diameter and 6 mm in length. A monotonically increasing load was applied at a constant cross-head speed of 0.001 mm/s using a screw-driven testing frame. The strain was measured using a linear variable differential transformer. The compressive yield strength was estimated using the 0.2% proof stress criterion.

Test Methodology for Measuring Density and Moduli

The shear and longitudinal wave speeds were measured ultrasonically on a cylindrical metallic glass specimen 3 mm in diameter and about 3 mm in length using a pulse-echo overlap set-up with 25 MHz piezoelectric transducers. The density was measured by the Archimedes method, as given in the American Society for Testing and Materials standard C693-93. Using the density and elastic constant values, the shear modulus and bulk modulus were evaluated. Using Hooke's law identities, the Young's modulus and Poisson's ratio were estimated from the shear and bulk moduli.

Methodology for Determining Elastic Strain Limit

The elastic strain limit is the determined by dividing the compressive yield strength by the Young's modulus.

Methodology for Determining Plastic Zone Radius

The plastic zone radius is estimated as $((K_Q^2/\pi\sigma_Y^2)$, where $K_Q$ is the notch toughness and $\sigma_Y$ the compressive yield strength.

It has now been discovered that certain nickel-based metallic glasses that can be formed in the bulk, in some cases into rods as thick as 10 mm, have certain properties, including high elastic modulus (Young's Modulus) (Y>120 GPa), large elastic strain limits ($\varepsilon_Y$~2% strain), high notch toughness (notch toughness $K_Q$>50 MPa·m$^{1/2}$), and sustained ductile bending, that may be exploited to enhance the design and performance of golf clubs beyond what is achievable with conventional metals or previously reported metallic glasses. Specifically, the use of these materials can enable fabrication of flexural membranes or shells used in golf club heads (drivers, fairways, hybrids, irons, wedges and putters) exhibiting enhanced flexural or bending compliance together with the ability to deform plastically and avoid brittle fracture or catastrophic failure when overloaded under bending loads. Further, the high strength of the material and its density, comparable to that of steel, enables the redistribution of mass in the golf club while maintaining a desired overall target mass. This in turn gives the golf club designer added freedom in many regards, for example in locating the center of gravity or adjusting the moments of inertia.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A golf club striking face, wherein at least a portion of the golf club striking face is formed from a metallic glass having an elastic strain limit of at least 1.4%, a Young's modulus greater than 120 GPa, and a notch toughness, defined as the stress intensity factor at crack initiation when measured on a 3 mm diameter rod containing a notch with length ranging from 1 to 2 mm and root radius ranging from 0.1 to 0.15 mm, of at least 50 MPa-m$^{1/2}$, and wherein the metallic glass forming the golf club striking face has a critical plate thickness of at least 1 mm, whereby a ratio of the stored elastic energy in the golf club striking face, $E_{MAX}$, in units of Joules, to the square of an average radius of the golf club striking face, $a^2$, in units of centimeters squared, at a striking force of 4,000 Newton, is at least 101 J/cm$^2$.

2. The golf club striking face of claim 1, wherein the notch toughness is at least 70 MPa-m$^{1/2}$.

3. The golf club striking face of claim 1, wherein the notch toughness is at least 90 MPa-m$^{1/2}$.

4. The golf club striking face of claim 1, wherein the notch toughness is greater than $\sigma_Y(0.3\pi t)^{1/2}$, where $\sigma_Y$ is the compressive yield strength of the metallic glass and t is the thickness of the metallic glass portion subject to bending load.

5. The golf club striking face of claim 1, wherein the metallic glass has at least one additional property, selected from the group consisting of: a mass density between 4.0 g/cc and 9 g/cc, a shear modulus of less than 55 GPa, a bulk modulus of at least 170 GPa, a Poisson's ratio of at least 0.35, a compressive yield strength of at least 2.0 GPa, a plastic zone radius estimated as $K_Q^2/p\sigma_Y^2$, where $\sigma_Y$ is the compressive yield strength of the metallic glass and $K_Q$ is the notch toughness, of at least 0.25 mm, an ability to sustain permanent plastic bending strain in a 3-point bend test of at least 1% in a sample having a thickness subject to bending load of at least 1 mm, and having a critical rod diameter of at least 3 mm diameter.

6. The golf club striking face of claim 1, wherein the metallic glass has at least two additional properties, selected from the group consisting of: a mass density between 4.0 g/cc and 9 g/cc, a shear modulus of less than 55 GPa, a bulk modulus of at least 170 GPa, a Poisson's ratio of at least 0.35, a compressive yield strength of at least 2.0 GPa, a plastic zone radius estimated as $K_Q^2/p\sigma_Y^2$, where $\sigma_Y$ is the compressive yield strength of the metallic glass and $K_Q$ is the notch toughness, of at least 0.25 mm, an ability to sustain permanent plastic bending strain in a 3-point bend test of at least 1% in a sample having a thickness subject to bending load of at least 1 mm, and having a critical rod diameter of at least 3 mm diameter.

7. The golf club striking face of claim 1, wherein the metallic glass has a mass density between 4.0 g/cc and 9 g/cc, a shear modulus of less than 55 GPa, a bulk modulus of at least 170 GPa, a Poisson's ratio of at least 0.35, a compressive yield strength of at least 2.0 GPa, a plastic zone radius estimated as $K_Q^2/p\sigma_Y^2$, where $\sigma_Y$ is the compressive yield strength of the metallic glass and $K_Q$ is the notch toughness, of at least 0.25 mm, an ability to sustain permanent plastic bending strain in a 3-point bend test of at least 1% in a sample having a thickness subject to bending load of at least 1 mm, and having a critical rod diameter of at least 3 mm diameter.

8. The golf club striking face of claim 1, wherein the metallic glass comprises:

$$X_{100-a-b}Y_aZ_b$$

where:

X is Ni, Fe, Co or combinations thereof;
Y is Cr, Mo, Nb, Ta or combinations thereof;
Z is P, B, Si or combinations thereof;
a is between 5 and 15 at %; and
b is between 15 and 25 at %.

9. The golf club striking face of claim 8, wherein the metallic glass may include one or more of the following elements in concentrations of up to 3 at %: W, Ru, Re, Cu, Pd, Pt, V, Sn.

10. The golf club striking face of claim 1, wherein the metallic glass comprises:

$$Ni_{100-a-b-c}W_aY_bZ_c$$

where:

W is Co, Fe, or combinations thereof;
Y is Cr, Mo, Nb, Ta or combinations thereof;
Z is P, B, Si or combinations thereof;
a is up to 40 at %;
b is between 5 and 15 at %;
and c is between 15 and 25 at %.

11. The golf club striking face of claim 1, wherein the metallic glass comprises:

$$Ni_{100-a-b-c}Cr_aY_bZ_c$$

where:

Y is Mo, Nb, Ta or combinations thereof;
Z is P, B, Si or combinations thereof;
a is between 5 and 10 at %;
b is between 2.5 and 5 at %, and
c is between 15 and 25 at %.

12. The golf club striking face of claim 1, wherein the metallic glass comprises:

$$Ni_{100-a-b-c-d}Cr_aY_bP_cZ_d$$

where:

Y is Mo, Nb, Ta, or combinations thereof;
Z is B, Si or combinations thereof;
a is between 5 and 10 at %;
b is between 2.5 and 5 at %,
c is between 16 and 19 at %, and
d is between 1 and 3.5 at %.

13. The golf club striking face of claim 1, wherein the golf club striking face has a thickness of at least 1 mm.

14. The golf club striking face of claim 1, wherein the metallic glass is selected from the group consisting of: $Ni_{71.4}Cr_{5.52}Nb_{3.38}P_{16.67}B_{3.03}$, $Ni_{72.5}Cr_5Nb_3P_{16.5}B_3$, $Ni_{70.75}Cr_7Ta_{2.75}P_{16.25}B_{3.25}$, $Ni_{69.9}Co_{1.5}Cr_{5.52}Nb_{3.38}P_{16.67}B_{3.03}$, $Ni_{67.1}Cr_{10}Nb_{3.4}P_{18}Si_{1.5}$, $Ni_{74}Mn_{3.5}Nb_3P_{16.5}B_3$, and $Ni_{72.3}Mo_3Nb_4Mn_1P_{16.5}B_{3.2}$.

* * * * *